US010702013B2

(12) United States Patent
Chiu

(10) Patent No.: US 10,702,013 B2
(45) Date of Patent: Jul. 7, 2020

(54) FOOTWEAR SOLE

(71) Applicant: Steve Yu-siang Chiu, British Columbia (CA)

(72) Inventor: Steve Yu-siang Chiu, British Columbia (CA)

( * ) Notice: Subject to any disclaimer, the term of this patent is extended or adjusted under 35 U.S.C. 154(b) by 0 days.

(21) Appl. No.: 16/683,378

(22) Filed: Nov. 14, 2019

(65) Prior Publication Data

US 2020/0077740 A1 Mar. 12, 2020

Related U.S. Application Data

(63) Continuation of application No. PCT/CA2019/050959, filed on Jul. 12, 2019.

(60) Provisional application No. 62/697,435, filed on Jul. 13, 2018.

(51) Int. Cl.

| | |
|---|---|
| ***A43B 13/18*** | (2006.01) |
| ***A43B 13/12*** | (2006.01) |
| ***A43B 7/14*** | (2006.01) |
| ***A43B 13/04*** | (2006.01) |
| ***A43B 23/22*** | (2006.01) |

(52) U.S. Cl.

CPC ..... *A43B 13/186* (2013.01); *A43B 7/1415* (2013.01); *A43B 13/04* (2013.01); *A43B 13/12* (2013.01); *A43B 13/188* (2013.01); *A43B 23/22* (2013.01); *A43B 23/227* (2013.01)

(58) Field of Classification Search

CPC ..... A43B 23/22; A43B 23/227; A43B 23/186; A43B 23/04; A43B 23/188; A43B 7/1415

USPC ..... 36/148, 149, 150

See application file for complete search history.

(56) References Cited

U.S. PATENT DOCUMENTS 4,398,357 A * 8/1983 Batra ..... A43B 13/16 36/129
4,785,557 A * 11/1988 Kelley ..... A43B 13/12 36/30 R
4,835,884 A 6/1989 Bianchini et al.
(Continued)

FOREIGN PATENT DOCUMENTS

EP 2653048 A1 10/2013
KR 100392898 B1 7/2003
(Continued)

OTHER PUBLICATIONS

International Search Report with Written Opinion for related Application No. PCT/CA2019/050959 dated Sep. 19, 2019 (11 Pages).
(Continued)

*Primary Examiner* — Ted Kavanaugh
(74) *Attorney, Agent, or Firm* — Riverside Law LLP

(57) ABSTRACT

A footwear sole includes an outsole assembly having a heel outsole, a forefoot outsole spaced axially apart from the heel outsole by an arch gap, and a sidewall extending between the heel outsole and the forefoot outsole. The sidewall has an elevated bottom edge extending axially along the arch gap on each of a medial and lateral side of the outsole assembly. The footwear sole further includes a support frame in the outsole assembly. The frame has an arch support surface extending axially along the arch gap at an elevation below at least a portion of each bottom edge. The footwear sole further includes a cushioning midsole in the outsole assembly and extending along the arch gap atop the arch support surface.

20 Claims, 8 Drawing Sheets

(56) References Cited

U.S. PATENT DOCUMENTS

| | | | | |
|---|---|---|---|---|
| 5,452,526 | A * | 9/1995 | Collins | A43B 1/0072 36/108 |
| 6,006,450 | A * | 12/1999 | Hayes | A43B 5/00 36/107 |
| 6,195,920 | B1 * | 3/2001 | Morris | A43B 1/0027 36/115 |
| 6,467,198 | B1 * | 10/2002 | James | A43B 1/10 36/115 |
| 7,377,056 | B2 | 5/2008 | Snow et al. | |
| 7,380,353 | B2 | 6/2008 | Feller et al. | |
| 7,451,557 | B2 | 11/2008 | McDonald et al. | |
| 10,517,353 | B1 * | 12/2019 | Recchi | A43B 7/1425 |
| 2007/0277401 | A1 * | 12/2007 | Young-Chul | A43B 13/12 36/30 R |
| 2015/0089841 | A1 | 4/2015 | Smaldone | |
| 2017/0202303 | A1 | 7/2017 | Shepherd et al. | |

FOREIGN PATENT DOCUMENTS

| | | | |
|---|---|---|---|
| WO | WO 8304166 | A1 | 12/1983 |
| WO | WO 2014/096422 | A1 | 6/2014 |

OTHER PUBLICATIONS

Page from https://www.wolfandshepherd.com/pages/performance-footwear. Accessed on Jul. 28, 2017.

* cited by examiner

FOOTWEAR SOLE

CROSS-REFERENCE TO RELATED APPLICATIONS

This application is a continuation on International Application No. PCT/CA2019/050959 filed on Jul. 12, 2019, which claims priority to U.S. provisional application No. 62/697,435 filed on Jul. 13, 2018, both of which are incorporated herein by reference in their entireties.

FIELD

The specification relates generally to footwear, and more specifically to a cushioned sole for heeled footwear such as a dress shoe or boot.

BACKGROUND

U.S. Pat. App. Pub. No. 2017/0202303 (Shepherd et al.) discloses a shoe comprising a sole and an upper secured to the sole. The sole has a lower sole member, a heel member, a shank member, a heel cushion, and a foot pad. The heel member extends downwardly from the lower sole member. The heel member includes a heel outer peripheral surface and an open top heel cavity. The lower sole member includes a top surface and a lower sole cavity extending downwardly from the top surface. The shank member has a shank midfoot portion and a shank heel portion. The shank midfoot portion is in the lower sole cavity and the shank heel portion is in the heel cavity. The heel cushion is in the heel cavity. The shank heel portion is sandwiched between the heel cushion and the heel member.

U.S. Pat. No. 7,380,353 (Feller et al.) discloses a footwear sole including a footwear sole base with a forefoot region, a mid-foot region, and a heel region. A lower heel cushion is positioned in the heel region. An upper heel cushion is positioned over the lower heel cushion. A shank with reinforcement ribs is positioned in the mid-foot region. A forefoot stabilizer is positioned in the forefoot region. The forefoot stabilizer includes an axial spine and lateral ribs.

U.S. Pat. No. 7,377,056 (Snow et al.) purports to disclose a shoe with increased flexibility in a forefoot portion that includes an upper, an upper lining, an outsole, a footbed, and a flexible insole. The flexible insole is located in the forefoot portion of the upper and is stitched directly to the upper lining along a perimeter of the flexible insole. The footbed includes a heel pad that is located in the heel portion of the shoe.

SUMMARY

The following summary is intended to introduce the reader to various aspects of the applicant's teaching, but not to define any invention.

According to some aspects, a sole for heeled footwear includes: (a) an outsole assembly extending axially between a heel end and a toe end and laterally between a medial side and a lateral side. The outsole assembly includes: (i) a heel outsole adjacent the heel end and having a heel underside surface for ground contact, (ii) a forefoot outsole adjacent the toe end and having a forefoot underside surface for ground contact, the forefoot outsole spaced axially apart from the heel outsole by an arch gap, and (iii) an outsole sidewall joined to the heel and forefoot outsoles and extending about an outer periphery of the outsole assembly. The outsole sidewall has a sidewall heel segment extending upwardly from the heel outsole, and a sidewall arch segment extending axially across the arch gap from the sidewall heel segment to the forefoot outsole. The sidewall arch segment has an elevated bottom edge on each of the medial side and the lateral side of the outsole assembly. Each bottom edge extends axially along the arch gap from the sidewall heel segment toward the forefoot outsole at an elevation above the heel underside surface. The outsole assembly further includes (iv) a heel cavity bounded from the heel end and the lateral and medial sides by the sidewall heel segment and from below by the heel outsole, the heel cavity open to the arch gap, and (v) an aperture passing vertically through the outsole assembly over the arch gap laterally intermediate the bottom edges of the sidewall arch segment, the aperture extending axially along the arch gap from the heel cavity toward the forefoot outsole. The sole further includes (b) a support frame nested within the outsole assembly. The support frame includes a frame floor having an arch support surface, the arch support surface extending axially along the arch gap from the heel cavity toward the forefoot outsole underneath the aperture at an elevation below the bottom edges of the sidewall arch segment. The sole further includes (c) a cushioning midsole nested within the outsole assembly and supported by the frame. The midsole has a heel cushion portion nested within the heel cavity and an arch cushion portion extending axially from the heel cushion portion along the arch gap, the arch cushion portion supported atop the arch support surface.

In some examples, the midsole tapers in thickness along the arch cushion portion toward the forefoot outsole.

In some examples, the midsole has a first cushion thickness at the heel cushion portion and a second cushion thickness at the arch cushion portion that is less than the first cushion thickness, and the midsole tapers in thickness along the arch cushion portion toward the forefoot outsole from the first cushion thickness to the second cushion thickness.

In some examples, the frame floor has a heel support surface extending over the heel outsole in the heel cavity, the heel cushion portion supported atop the heel support surface and the arch support surface extending along the arch gap from the heel support surface.

In some examples, the arch support surface has a convex curvature along the arch gap.

In some examples, the midsole includes a forefoot cushion portion extending from the arch cushion portion and over the forefoot outsole.

In some examples, the frame floor extends over the heel outsole, the arch gap, and the forefoot outsole, and the frame has a frame sidewall extending upwardly from a periphery of the frame floor and along the outsole sidewall. The midsole is nested in the frame inboard of the frame sidewall. In some examples, the frame sidewall has a frame sidewall upper edge and a plurality of axially spaced apart cut outs in a forefoot region of the frame sidewall upper edge to facilitate flexing of the frame in the forefoot region during use.

In some examples, the sidewall heel segment has a heel segment lower portion extending upwardly from the heel outsole and a heel segment upper portion supported atop the heel segment lower portion. The sidewall arch segment is joined to the heel segment upper portion and spaced vertically apart from the heel outsole by the heel segment lower portion.

In some examples, the outsole sidewall has a horizontally outer surface extending about the outer periphery of the outsole assembly and formed of leather.

In some examples, an entirety of the outsole sidewall is formed of leather. In some examples, at least a portion of the heel outsole is formed of leather. In some examples, at least a portion of the forefoot outsole is formed of leather.

According to some aspects, a footwear sole includes: (a) an outsole assembly including: (i) a heel outsole having a heel underside surface for ground contact, (ii) a forefoot outsole spaced axially apart from the heel outsole by an arch gap, and (iii) an outsole sidewall extending about an outer periphery of the outsole assembly. The outsole sidewall has a sidewall arch segment extending across the arch gap. The sidewall arch segment has an elevated bottom edge on each of a medial side and a lateral side of the outsole assembly. Each bottom edge extends axially along the arch gap at an elevation above the heel underside surface. The sole further includes (b) a support frame in the outsole assembly. The support frame includes a frame floor having an arch support surface extending axially along the arch gap from the heel outsole toward the forefoot outsole at an elevation below the bottom edges of the sidewall arch segment. The sole further includes (c) a cushioning midsole in the outsole assembly and supported by the frame. The midsole has a heel cushion portion above the heel outsole and an arch cushion portion extending axially from the heel cushion portion along the arch gap, the arch cushion portion supported atop the arch support surface.

In some examples, the midsole tapers in thickness along the arch cushion portion toward the forefoot outsole.

In some examples, the midsole has a first cushion thickness at the heel cushion portion and a second cushion thickness at the arch cushion portion that is less than the first cushion thickness. In some examples, the midsole tapers in thickness along the arch cushion portion toward the forefoot outsole from the first cushion thickness to the second cushion thickness.

In some examples, the outsole sidewall has a sidewall heel segment extending upwardly from the heel outsole, and the outsole assembly has a heel cavity bounded from a heel end of the outsole assembly and the lateral and medial sides by the sidewall heel segment and from below by the heel outsole. The heel cavity is open to the arch gap. The heel cushion portion is nested in the heel cavity.

In some examples, the outsole assembly has an aperture passing vertically therethrough over the arch gap laterally intermediate the bottom edges of the sidewall arch segment. The aperture extends axially along the arch gap from the heel cavity toward the forefoot outsole. The arch support surface extends axially along the arch gap from the heel cavity toward the forefoot outsole underneath the aperture.

In some examples, the sidewall heel segment has a heel segment lower portion extending upwardly from the heel outsole and a heel segment upper portion supported atop the heel segment lower portion, and the sidewall arch segment is joined to the heel segment upper portion and spaced vertically apart from the heel outsole by the heel segment lower portion.

In some examples, the frame floor has a heel support surface extending over the heel outsole. The heel cushion portion is supported atop the heel support surface and the arch support surface extends axially along the arch gap from the heel support surface.

In some examples, the arch support surface has a convex curvature along the arch gap.

In some examples, the midsole includes a forefoot cushion portion extending from the arch cushion portion and over the forefoot outsole.

In some examples, the frame floor extends over the heel outsole, the arch gap, and the forefoot outsole, and the frame has a frame sidewall extending upwardly from a periphery of the frame floor and along the outsole sidewall. The midsole is nested in the frame inboard of the frame sidewall. In some examples, the frame sidewall has a frame sidewall upper edge and a plurality of axially spaced apart cut outs in a forefoot region of the frame sidewall upper edge to facilitate flexing of the frame in the forefoot region during use.

In some examples, the outsole sidewall has a horizontally outer surface extending about the outer periphery of the outsole assembly and formed of leather. In some examples, an entirety of the outsole sidewall is formed of leather. In some examples, at least a portion of the heel outsole is formed of leather. In some examples, at least a portion of the forefoot outsole is formed of leather.

According to some aspects, a footwear sole includes an outsole assembly having a heel outsole, a forefoot outsole spaced axially apart from the heel outsole by an arch gap, and a sidewall extending between the heel outsole and the forefoot outsole. The sidewall has an elevated bottom edge extending axially along the arch gap on each of a medial and lateral side of the outsole assembly. The footwear sole further includes a support frame in the outsole assembly. The frame has an arch support surface extending axially along the arch gap at an elevation below at least a portion of each bottom edge. The footwear sole further includes a cushioning midsole in the outsole assembly and extending along the arch gap atop the arch support surface.

BRIEF DESCRIPTION OF THE DRAWINGS

The drawings included herewith are for illustrating various examples of articles, methods, and apparatuses of the present specification and are not intended to limit the scope of what is taught in any way. In the drawings:

FIG. 5A is a simplified cross-sectional view of the footwear article of

FIG. 1, taken along line 5A-5A in FIG. 4 and with background features removed;

DETAILED DESCRIPTION

Various articles or processes will be described below to provide an example of an embodiment of each claimed invention. No embodiment described below limits any claimed invention and any claimed invention may cover processes or articles that differ from those described below. The claimed inventions are not limited to articles or processes having all of the features of any one article or process described below or to features common to multiple or all of the articles described below. It is possible that an article or process described below is not an embodiment of any claimed invention. Any invention disclosed in an article or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Leather footwear, such as leather dress shoes or leather boots, can include a leather sole and an upper joined to the leather sole. The leather sole is often formed from layers of leather, and usually includes a stepped heel having a heel outsole with a heel underside surface for ground contact, a forefoot portion having a forefoot outsole spaced axially apart from the heel by an arch gap, and an elevated arch portion extending across the arch gap between the heel and the forefoot portion. In such constructions, the elevated arch portion has an arch underside surface extending along the arch gap from a rear end adjacent the heel and at an elevation above the heel underside surface to a front end adjacent the forefoot portion. Such leather sole constructions are in some cases designed for aesthetic appeal and serviceability (e.g. replacement of outsole portions), but may be found to provide insufficient cushioning and/or shock absorption.

The present application discloses a footwear sole construction that can accommodate a cushioning midsole extending across the heel and arch portions to facilitate shock absorption, while retaining some of the desirable aesthetic features of a traditional leather sole construction having a stepped heel and an elevated arch portion. Some of the design aspects disclosed herein may also allow for a cushioning midsole that is relatively thick in the heel portion and tapers gradually in thickness along the arch portion, to facilitate a natural ride or feel when transitioning a step from heel to toe.

Figure 1:
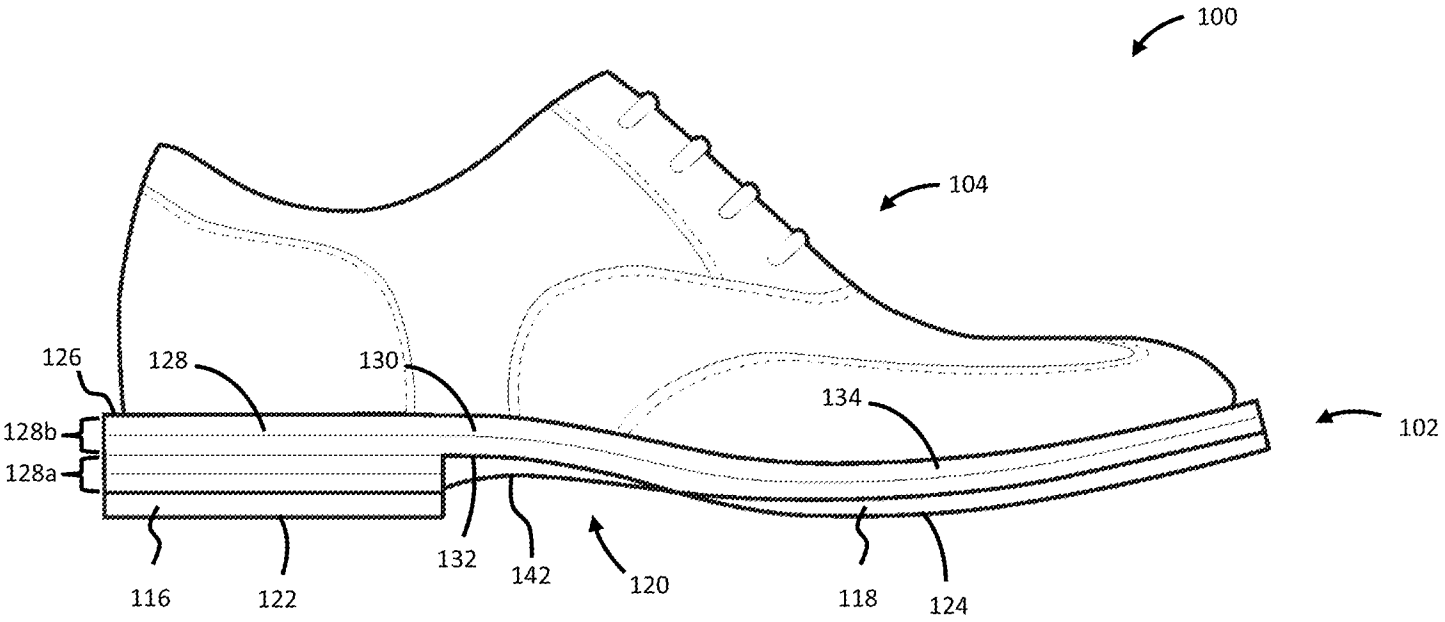
FIG. 1 is a side elevation view of an example footwear article.

Referring to FIG. 1, an example footwear article 100 is shown. The footwear article 100 can be, for example, a dress shoe or boot. In the example illustrated, the footwear article 100 is a dress shoe. In the example illustrated, the footwear article 100 includes a sole 102 (also referred to as footwear sole 102) and an upper 104 joined to the sole 102.

Figure 2:
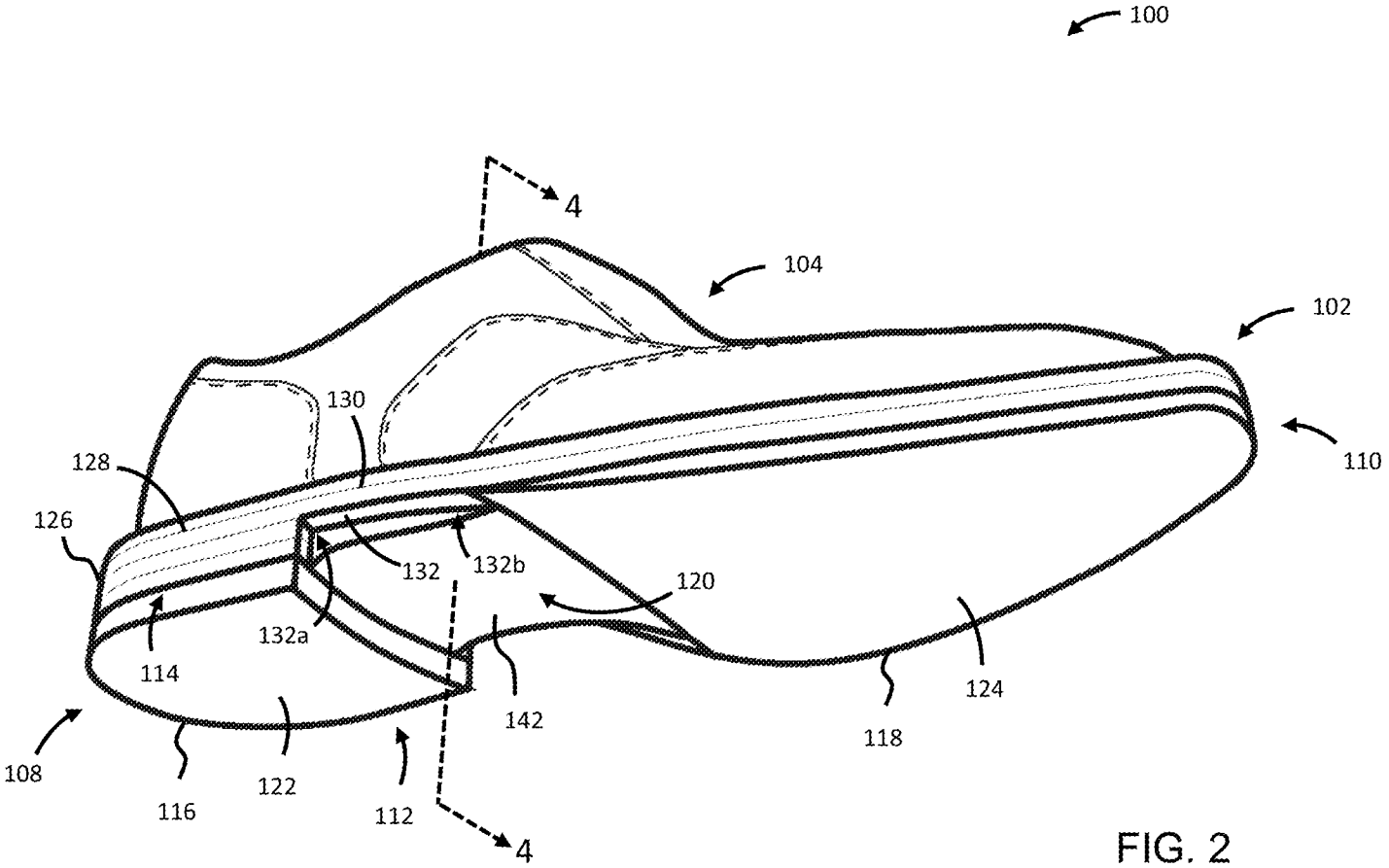
FIG. 2 is a bottom perspective view of the footwear article of FIG. 1.
Figure 3:
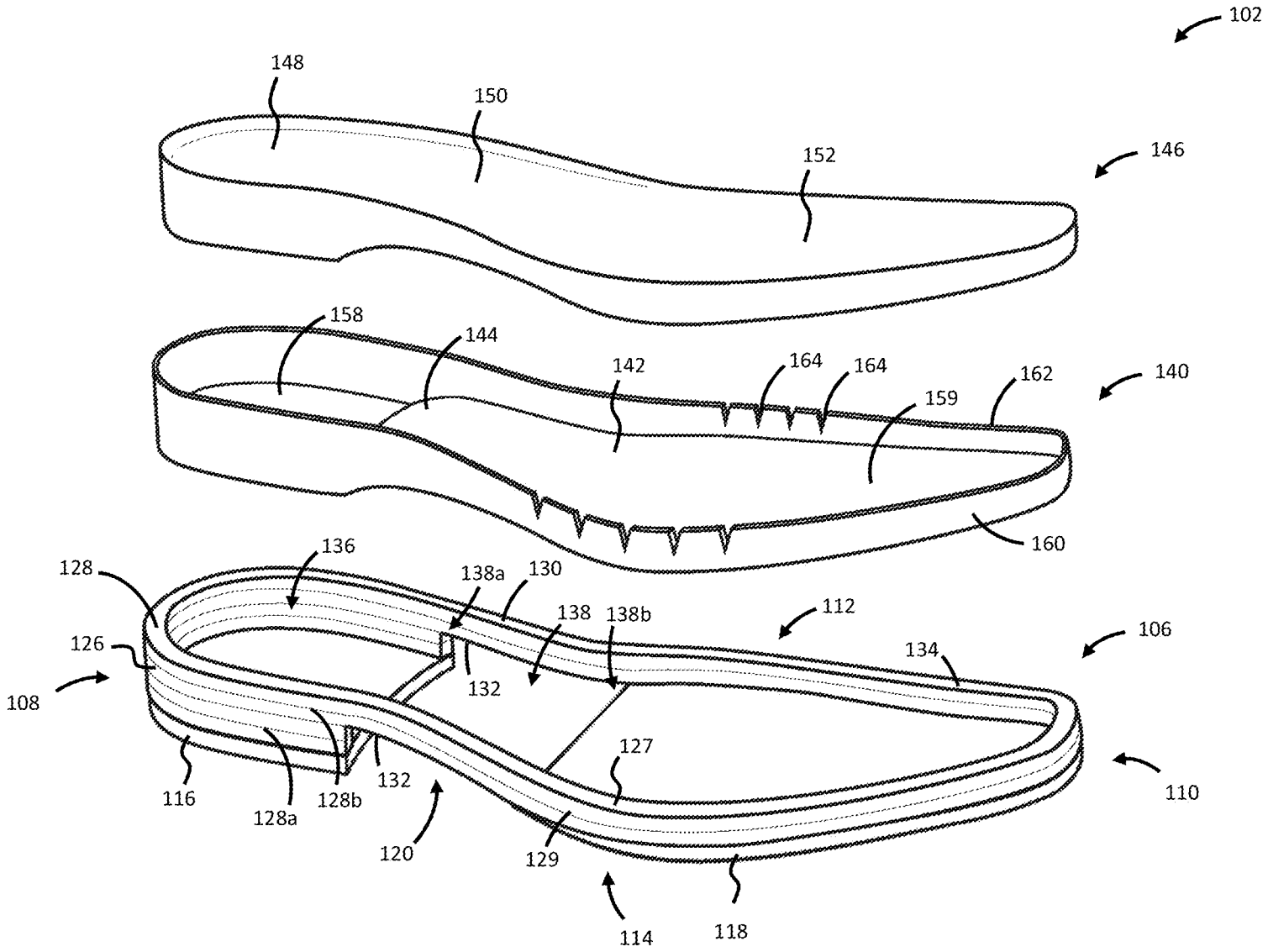
FIG. 3 is an exploded perspective view of a sole assembly of the footwear article of FIG. 1.

Referring to FIG. 2, in the example illustrated, the sole 102 includes an outsole assembly 106 extending axially between a heel end 108 and a toe end 110, and laterally between a medial side 112 and a lateral side 114 (see also FIG. 3). In the example illustrated, the outsole assembly 106 is constructed to have aesthetic features of a traditional leather sole construction having a stepped heel and elevated arch portion. At least a portion of the outsole assembly 106 can be formed of leather to help provide the appearance of a traditional leather outsole construction. The leather can comprise, for example, natural and/or artificial leather.

In the example illustrated, the outsole assembly 106 includes a heel outsole 116 adjacent the heel end 108 and a forefoot outsole 118 adjacent the toe end 110 and spaced axially apart from the heel outsole 116 by an arch gap 120. In the example illustrated, the heel outsole 116 has a heel underside surface 122 for ground contact, and the forefoot outsole 118 has a forefoot underside surface 124 for ground contact. In the example illustrated, the heel underside surface 122 is generally planar and extends from the heel end 108 to the arch gap 120. In the example illustrated, at least a portion of the heel outsole 116 is formed of leather. In the example illustrated, at least a portion of the forefoot outsole 118 is formed of leather.

In the example illustrated, the outsole assembly 106 further includes an outsole sidewall 126 joined to the heel and forefoot outsoles 116, 118 and extending about a periphery of the outsole assembly 106. Referring to FIG. 3, in the example illustrated, the outsole sidewall 126 has a sidewall top edge 127 extending continuously about the periphery of the outsole assembly 106 (and the upper 104). The outsole sidewall 126 further has a horizontally outer surface 129 extending continuously about the periphery of the outsole assembly 106.

At least a portion of the outsole sidewall 126 (e.g. the outer surfaces that are visible when the footwear article 100 is worn) can be formed of leather. In some examples, the sidewall top edge 127 and the horizontally outer surface 129 of the outsole sidewall 126 are formed of leather. In some examples, the outsole sidewall 126 can be formed entirely of leather, and in the example illustrated, the outsole sidewall 126 is formed of a plurality of stacked leather layers.

In the example illustrated, the outsole sidewall 126 has a sidewall heel segment 128 extending upwardly from the heel outsole 116, and a sidewall arch segment 130 extending axially across the arch gap 120 from the sidewall heel segment 128 to the forefoot outsole 118. The sidewall arch segment 130 has an elevated arch segment bottom edge 132 on each of the medial side 112 and the lateral side 114 of the outsole assembly 106. Referring to FIG. 1, each arch segment bottom edge 132 extends axially along the arch gap 120 from the sidewall heel segment 128 toward the forefoot outsole 118 at an elevation above the heel underside surface 122. This can help provide the sole 102 with the appearance of having a stepped heel and elevated arch portion like in a traditional leather outsole construction. Referring to FIG. 2, in the example illustrated, each arch segment bottom edge 132 has a bottom edge rear end **132*a* adjacent the sidewall heel segment 128 and a bottom edge front end 132*b* spaced axially apart from the bottom edge rear end 132*a* toward the forefoot outsole 118. The bottom edge rear end 132*a* is at an elevation above the heel underside surface 122**.

Referring to FIG. 3, in the example illustrated, the outsole assembly 106 further includes a sidewall forefoot segment 134 extending upwardly from the forefoot outsole 118. The sidewall arch segment 130 extends axially across the arch gap 120 between the sidewall heel segment 128 and the sidewall forefoot segment 134.

In the example illustrated, the outsole assembly 106 includes a heel cavity 136 bounded from the heel end 108 and the medial and lateral sides 112, 114 by the sidewall heel segment 128 and from below by the heel outsole 116. In the example illustrated, the heel cavity 136 is open to the arch gap 120. In the example illustrated, the cavity extends vertically from a top surface of the heel outsole 116 to the sidewall top edge 127 and axially from an inner rear surface of the sidewall heel segment 128 to the arch gap 120.

In the example illustrated, the outsole assembly 106 further includes an aperture 138 passing vertically therethrough over the arch gap 120 laterally intermediate the bottom edges 132 of the sidewall arch segment 130. In the example illustrated, the aperture 120 extends axially along the arch gap 120 from the heel cavity 136 toward the forefoot outsole 118. In the example illustrated, the aperture 138 extends vertically through the outsole assembly 106 from the sidewall top edge 127 to the arch segment bottom edges 132. In the example illustrated, the aperture 138 has an aperture rear end 138*a* open to the heel cavity 136 and an aperture front end 138*b* spaced axially apart from the aperture rear end 138*a* toward the forefoot outsole 118. In the example illustrated, the aperture rear end 138*b* extends laterally from the arch segment bottom edge 132 on the medial side 112 to the arch segment bottom edge 132 on the lateral side 114. In the example illustrated, the aperture 138 extends axially across the arch gap 120 from the heel cavity 136 to the forefoot outsole 118.

Referring to FIG. 3, in the example illustrated, the sole 102 includes a support frame 140 nested within the outsole assembly 106. In the example illustrated, the support frame 140 is nested inboard of the horizontally outer surface 129 of the outsole sidewall 126 (see also FIG. 4). In the example illustrated, the frame 140 is generally rigid, and can help provide rigidity and stiffness to the outsole assembly 106. The frame 140 can be formed from, for example, thermoplastic polyurethane (TPU), poly(methyl methacrylate) (PMMA), polycarbonate (PC), acrylonitrile butadiene styrene (ABS), carbon fibre, and/or another suitable material.

Figure 4:
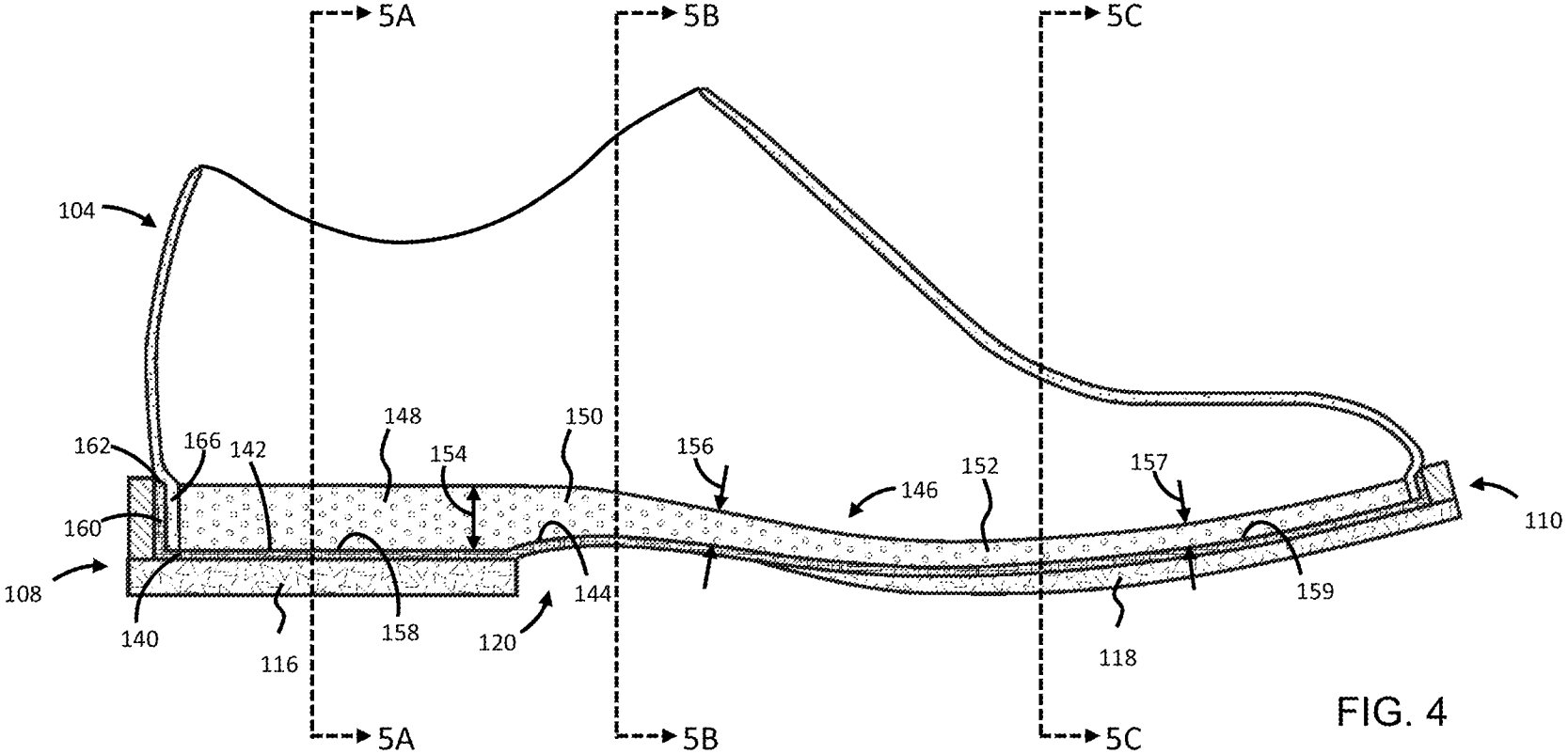
FIG. 4 is a cross-sectional view of the footwear article of FIG. 1, taken along line 4-4 in FIG. 2.
Figure 5C:
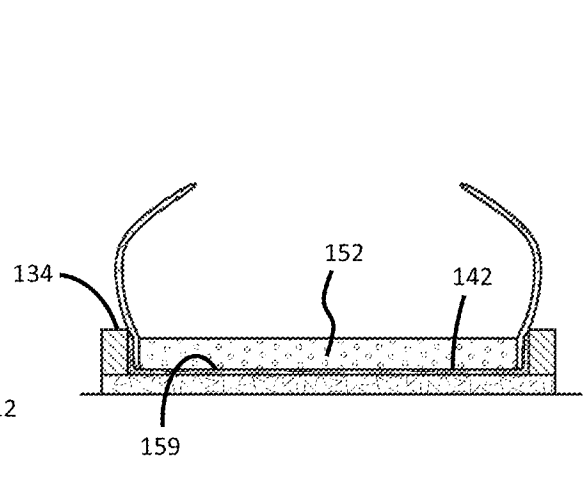
FIG. 5C is a simplified cross-sectional view of the footwear article of FIG. 1, taken along line 5C-5C in FIG. 4 and with background features removed.
Figure 5B:
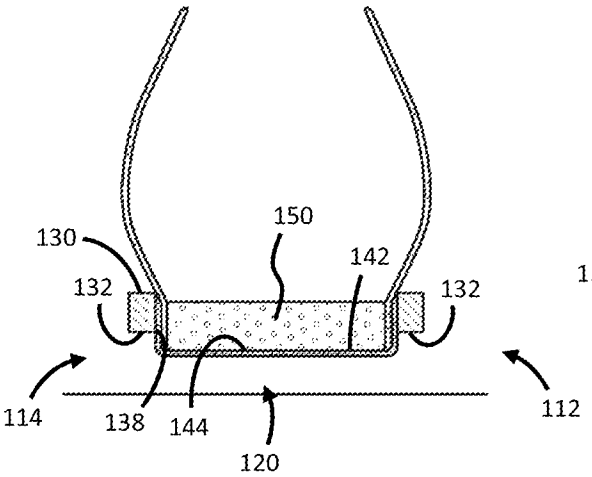
FIG. 5B is a simplified cross-sectional view of the footwear article of FIG. 1, taken along line 5B-5B in FIG. 4 and with background features removed.

Referring to FIG. 4, in the example illustrated, the support frame 140 includes a frame floor 142 having an arch support surface 144 extending axially along the arch gap 120. In the example illustrated, the arch support surface 144 extends axially along the arch gap 120 from the heel outsole 116 toward the forefoot outsole 118 at an elevation below the bottom edges 132 of the sidewall arch segment 130 (see also FIG. 5B). In the example illustrated, the arch support surface 144 extends axially along the arch gap 120 from the heel outsole 116 below the bottom edge rear end 132*a*. In the example illustrated, the arch support surface 144 extends axially along the arch gap 120 from the heel cavity 136 toward the forefoot outsole 118 underneath the aperture 138 at an elevation below the bottom edges 132 of the sidewall arch segment 130. Lowering the arch support surface 144 relative to the elevated bottom edges 132 of the sidewall arch segment 130 can help allow for thicker arch cushioning while helping to retain the appearance of a stepped heel and elevated arch portion like that in a traditional leather sole construction, and may further help accommodate a gradual transition in cushion thickness along the sole 102.

Referring to FIG. 3, in the example illustrated, the sole 102 further includes a cushioning midsole 146 nested within the outsole assembly 106 and supported by the frame 140. In the example illustrated, the midsole 146 can be formed of, for example, foamed materials, polyurethane (PU), thermoplastic polyurethane (TPU), ethylene-vinyl acetate (EVA), and/or another material suitable for providing midsole cushioning to a wearer of the footwear article 100.

Referring to FIG. 4, in the example illustrated, the midsole 146 extends axially from above the heel outsole 116 and along the arch gap 120 atop the arch support surface 144 of the support frame 140. In the example illustrated, the midsole 146 has a heel cushion portion 148 nested within the heel cavity 136, and an arch cushion portion 150 extending axially from the heel cushion portion 148 along the arch gap 120 and supported atop the arch support surface 144. In the example illustrated, the heel cushion portion 148 is of integral, unitary, one-piece construction with the arch cushion portion 150.

In the example illustrated, the arch cushion portion 150 tapers in thickness along the arch gap 120 toward the forefoot outsole 118. In the example illustrated, the midsole 146 has a first cushion thickness 154 at the heel cushion portion 148 and a second cushion thickness 156 at the arch cushion portion 150 that is less than the first cushion thickness 154. In the example illustrated, the midsole 146 tapers in thickness along the arch cushion portion 150 toward the forefoot outsole 118 from the first cushion thickness 154 to the second cushion thickness 156.

In the example illustrated, the midsole 146 further includes a forefoot cushion portion 152 extending from the arch cushion portion 150 and over the forefoot outsole 118. In the example illustrated, the forefoot cushion portion 152 is of integral, unitary, one-piece construction with the heel and arch cushion portions 148, 150. In the example illustrated, the midsole 146 has a third cushion thickness 157 in the forefoot cushion portion 152 that is less than the second cushion thickness 156. In the example illustrated, the midsole 146 tapers in thickness toward the toe end 110 from the second cushion thickness 156 to the third cushion thickness 157.

Referring to FIG. 3, in the example illustrated, the sidewall heel segment 128 has a heel segment lower portion 128*a* extending upwardly from the heel outsole 116 and a heel segment upper portion 128*b* supported atop the heel segment lower portion 128*a*. In the example illustrated, the sidewall arch segment 130 is joined to the heel segment upper portion 128*b* and spaced vertically apart from the heel outsole 116 by the heel segment lower portion 128*a*. In the example illustrated, each bottom edge 132 of the sidewall arch segment 130 curves downwardly along the arch gap 120 from the sidewall heel segment 128 toward the forefoot outsole 118.

Referring to FIG. 4, in the example illustrated, the frame floor 142 has a heel support surface 158 in the heel cavity 136 and extending over the heel outsole 116. The heel cushion portion 148 is supported atop the heel support surface 158, and the arch support surface 144 extends along the arch gap 120 from the heel support surface 158. In the example illustrated, the heel support surface 158 is generally planar. In the example illustrated, the arch support surface 144 has a convex curvature along the arch gap 120. This may help increase structural rigidity of the support frame 140, and may help provide arch support to a wearer.

In the example illustrated, the frame floor 142 has a forefoot support surface 159 extending over the forefoot outsole 118. The forefoot cushion portion 152 is supported atop the forefoot support surface 159, and the arch support surface 144 extends continuously from the heel support surface 158 to the forefoot support surface 159.

Referring to FIG. 3, in the example illustrated, the frame floor 142 extends over the heel outsole 116, the arch gap 120, and the forefoot outsole 118, and the frame 140 has a frame sidewall 160 extending upwardly from and about a periphery of the frame floor 142 and along the outsole sidewall 126. In the example illustrated, the midsole 146 is nested in the support frame 140 inboard of the frame sidewall 160. In the example illustrated, the frame sidewall 160 has a frame sidewall upper edge 162 and a plurality of axially spaced apart cut outs 164 in a forefoot region of the frame sidewall upper edge 162 to facilitate flexing of the support frame 140 in the forefoot region during use. In the example illustrated, the frame 140 is of integral, unitary, one-piece construction.

In the example illustrated, the outsole sidewall 126 is shown as a relatively thick structural sidewall formed of stacked leather layers, and the frame sidewall 160 is shown thinner relative to the outsole sidewall 126. In some examples, the outsole sidewall 126 can comprise, for example, a relatively thin leather cladding wrapped around outer portions of the support frame 140 such as, for example, a relatively thicker frame sidewall.

Figure 5A:
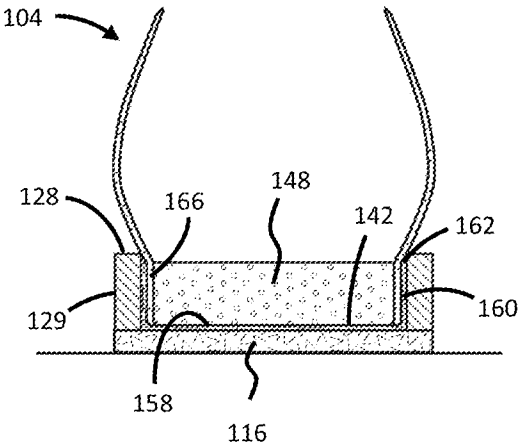

Referring to FIG. 4, in the example illustrated, the upper 104 has a lower portion 166 sandwiched between the support frame 140 and the midsole 146 to facilitate joining of the upper 104 to the sole 102 (see also FIG. 5A). In the example illustrated, the lower portion 166 of the upper 104 is sandwiched laterally intermediate the frame sidewall 160 and the midsole 146. In the example illustrated, the upper 104 is formed of leather.

Figure 6:
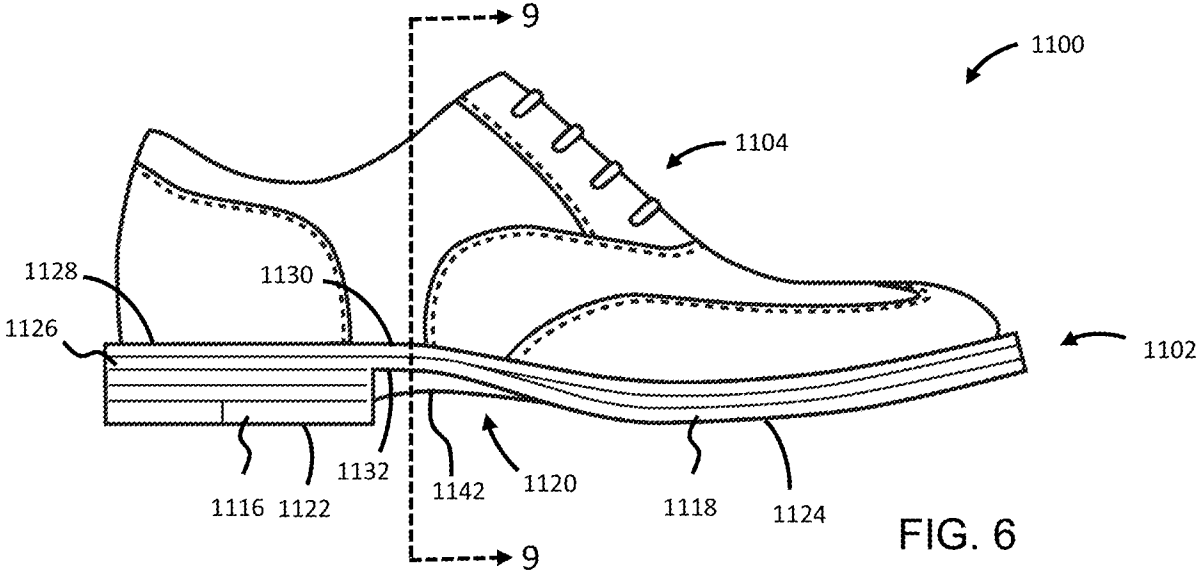
FIG. 6 is a side elevation view of another example footwear article.

Referring to FIG. 6, another example footwear article 1100 is shown. The footwear article 1100 is similar to the footwear article 100, and like features are indicated with like reference characters, incremented by 1000.

Figure 7:
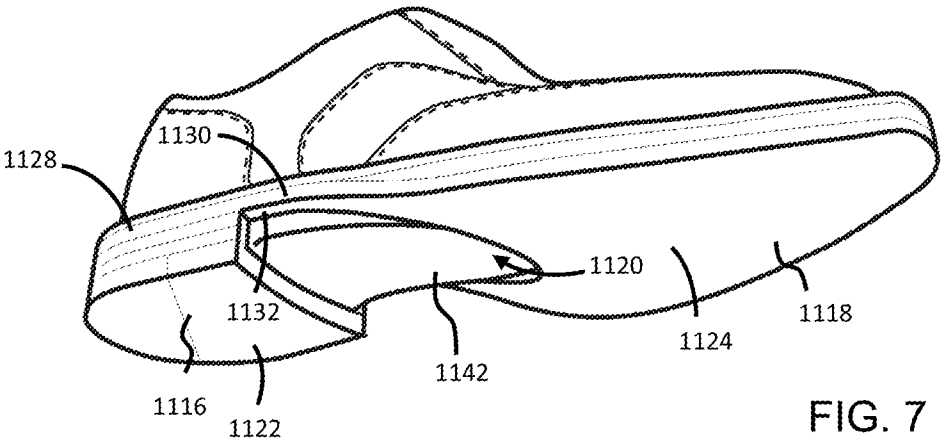
FIG. 7 is a bottom perspective view of the footwear article of FIG. 6.
Figure 8:
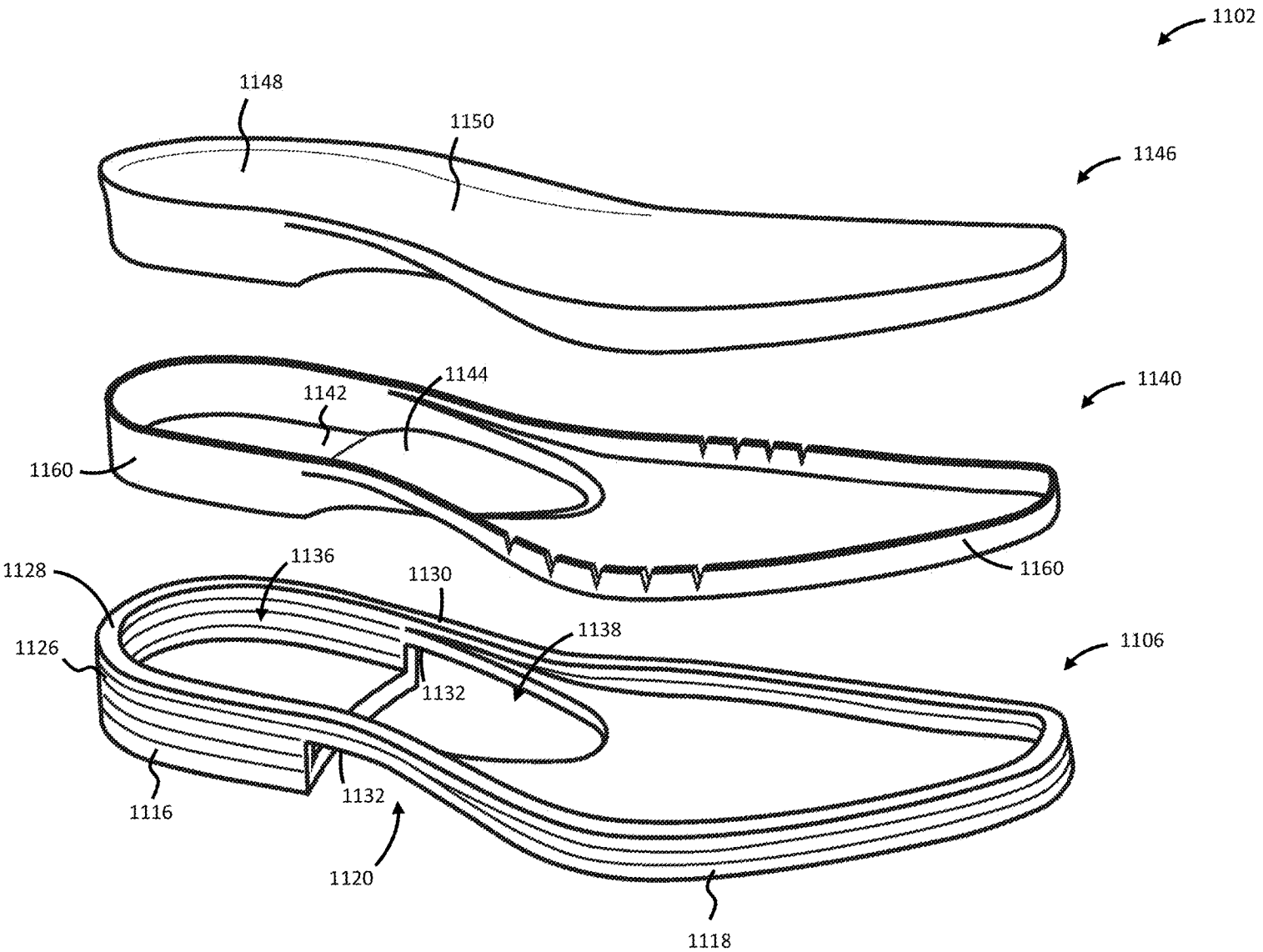
FIG. 8 is an exploded perspective view of a sole assembly of the footwear article of FIG. 6.

In the example illustrated, the footwear article 1100 includes a sole 1102 and an upper 1104 joined to the sole 1102. Referring to FIG. 8, in the example illustrated, the sole 1102 includes an outsole assembly 1106 having a heel outsole 1116 and a forefoot outsole 1118 spaced axially apart from the heel outsole 1116 by an arch gap 1120. In the example illustrated, the heel outsole 1116 has a heel underside surface 1122 (FIG. 7) for ground contact, and the forefoot outsole 1118 has a forefoot underside surface 1124 (FIG. 7) for ground contact.

In the example illustrated, the outsole assembly 1106 further includes an outsole sidewall 1126 joined to the heel and forefoot outsoles 1116, 1118 and extending about a periphery of the outsole assembly. The outsole sidewall 1126 has a sidewall heel segment 1128 extending upwardly from the heel outsole 1116, and a sidewall arch segment 1130 extending axially across the arch gap 1120 from the sidewall heel segment 1128 to the forefoot outsole 1118. The sidewall arch segment 1130 has an elevated arch segment bottom edge 1132 on each of a medial side and a lateral side of the outsole assembly 1106. Referring to FIG. 6, each bottom edge 1132 extends axially along the arch gap 1120 from the sidewall heel segment 1128 toward the forefoot outsole 1118 at an elevation above the heel underside surface 1122.

Referring to FIG. 8, in the example illustrated, the outsole assembly 1106 further includes a heel cavity 1136 bounded from a heel end of the outsole assembly 1106 and the medial and lateral sides 1112, 1114 by the sidewall heel segment 1128 and from below by the heel outsole 1116. In the example illustrated, the heel cavity 1136 is open to the arch gap 1120. In the example illustrated, the outsole assembly 1106 further includes an aperture 1138 passing vertically therethrough over the arch gap 1120 laterally intermediate the arch segment bottom edges 1132. In the example illustrated, the aperture extends axially along the arch gap 1120 from the heel cavity 1136 toward the forefoot outsole 1118.

Figure 9:
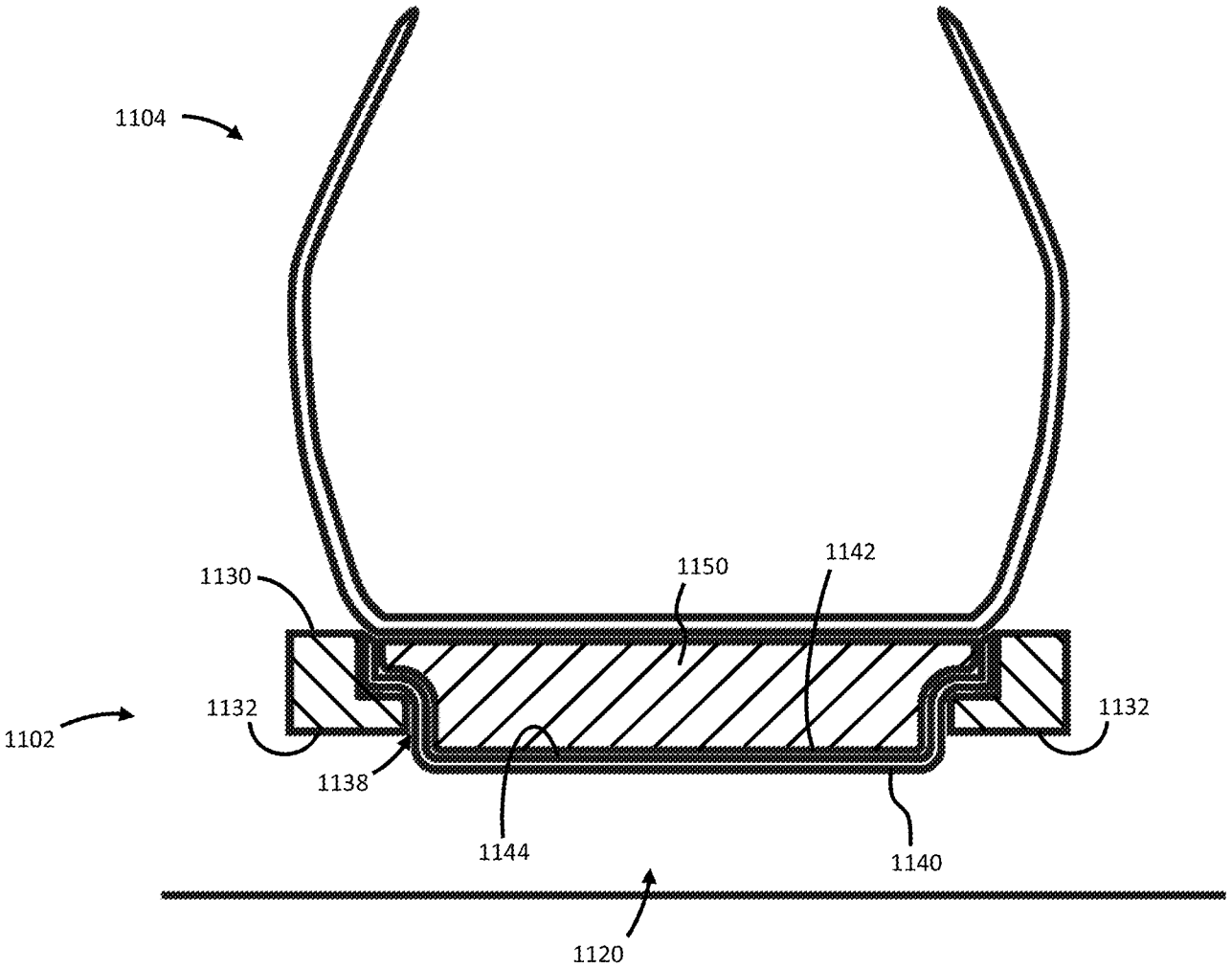
FIG. 9 is a simplified cross-sectional view of the footwear article of FIG. 6, taken along line 9-9 in FIG. 6 and with background features removed.

In the example illustrated, the sole 1102 further includes a support frame 1140 nested within the outsole assembly 1106. Referring to FIG. 9, in the example illustrated, the support frame 1140 includes a frame floor 1142 having an arch support surface 1144 extending axially along the arch gap 1120 from the heel cavity 1136 (FIG. 8) toward the forefoot outsole 1118 underneath the aperture 1138 at an elevation below the bottom edges 1132 of the sidewall arch segment 1130.

Referring to FIG. 8, in the example illustrated, the sole 1102 further includes a cushioning midsole 1146 nested within the outsole assembly 1106 and supported by the frame 1140. The midsole 1146 has a heel cushion portion 1148 nested within the heel cavity 1136, and an arch cushion portion 1150 extending axially from the heel cushion portion 1148 along the arch gap 1120 and supported atop the arch support surface 1144 of the support frame 1140. In the example illustrated, the arch cushion portion 1150 tapers in thickness along the arch gap 1120 toward the forefoot outsole 1118.

In the example illustrated, the frame 1140 has a frame sidewall 1160 extending upwardly from and about a periphery of the frame floor 1142 adjacent the outsole sidewall 1126. In the example illustrated, the midsole 1146 is nested in the support frame 1140 inboard of the frame sidewall 1160.

In the example illustrated, the upper 1104 can be joined to the sole 1102 using, for example, a Strobel or California last.

The invention claimed is:

1. A sole for heeled footwear, comprising:

a) an outsole assembly extending axially between a heel end and a toe end and laterally between a medial side and a lateral side, the outsole assembly including:

i) a heel outsole adjacent the heel end and having a heel underside surface for ground contact, ii) a forefoot outsole adjacent the toe end and having a forefoot underside surface for ground contact, the forefoot outsole spaced axially apart from the heel outsole by an arch gap, iii) an outsole sidewall joined to the heel outsole and the forefoot outsole and extending about an outer periphery of the outsole assembly, the outsole sidewall having a sidewall heel segment extending upwardly from the heel outsole, and a sidewall arch segment extending axially across the arch gap from the sidewall heel segment to the forefoot outsole, the sidewall arch segment having an elevated bottom edge on each of the medial side and the lateral side of the outsole assembly, each bottom edge extending axially along the arch gap from the sidewall heel segment toward the forefoot outsole at an elevation above the heel underside surface, iv) a heel cavity bounded from the heel end and the lateral and medial sides by the sidewall heel segment and from below by the heel outsole, the heel cavity open to the arch gap, and v) an aperture passing vertically through the outsole assembly over the arch gap laterally intermediate the bottom edges of the sidewall arch segment, the aperture extending axially along the arch gap from the heel cavity toward the forefoot outsole;

b) a support frame nested within the outsole assembly, the support frame including a frame floor having an arch support surface, the arch support surface extending axially along the arch gap from the heel cavity toward the forefoot outsole underneath the aperture at an elevation below the bottom edges of the sidewall arch segment; and c) a cushioning midsole nested within the outsole assembly and supported by the frame, the midsole having a heel cushion portion nested within the heel cavity and an arch cushion portion extending axially from the heel cushion portion along the arch gap, the arch cushion portion supported atop the arch support surface.

2. The sole of claim 1, wherein the midsole tapers in thickness along the arch cushion portion toward the forefoot outsole.

3. The sole of claim 2, wherein the midsole has a first cushion thickness at the heel cushion portion and a second cushion thickness at the arch cushion portion that is less than the first cushion thickness, and wherein the midsole tapers in thickness along the arch cushion portion toward the forefoot outsole from the first cushion thickness to the second cushion thickness.

4. The sole of claim 1, wherein the frame floor has a heel support surface extending over the heel outsole in the heel cavity, the heel cushion portion supported atop the heel support surface and the arch support surface extending along the arch gap from the heel support surface.

5. The sole of claim 1, wherein the arch support surface has a convex curvature along the arch gap.

6. The sole of claim 1, wherein the midsole includes a forefoot cushion portion extending from the arch cushion portion and over the forefoot outsole.

7. The sole of claim 1, wherein the frame floor extends over the heel outsole, the arch gap, and the forefoot outsole, and wherein the frame has a frame sidewall extending upwardly from a periphery of the frame floor and along the outsole sidewall, the midsole nested in the frame inboard of the frame sidewall.

8. The sole of claim 1, wherein the sidewall heel segment has a heel segment lower portion extending upwardly from the heel outsole and a heel segment upper portion supported atop the heel segment lower portion, and wherein the sidewall arch segment is joined to the heel segment upper portion and spaced vertically apart from the heel outsole by the heel segment lower portion.

9. The sole of claim 1, wherein the outsole sidewall has a horizontally outer surface extending about the outer periphery of the outsole assembly, the horizontally outer surface formed of leather.

10. A footwear sole comprising:

a) an outsole assembly including: a heel outsole having a heel underside surface for ground contact, a forefoot outsole spaced axially apart from the heel outsole by an arch gap, and an outsole sidewall extending about an outer periphery of the outsole assembly, the outsole sidewall having an arch segment extending across the arch gap, the arch segment having an elevated bottom edge on each of a medial side and a lateral side of the outsole assembly;

b) a support frame in the outsole assembly, the support frame including a frame floor having an arch support surface extending axially along the arch gap from the heel outsole toward the forefoot outsole at an elevation below the bottom edges of the sidewall arch segment; and c) a cushioning midsole in the outsole assembly and supported by the frame, the midsole having a heel cushion portion above the heel outsole and an arch cushion portion extending axially from the heel cushion portion along the arch gap, the arch cushion portion supported atop the arch support surface.

11. The footwear sole of claim 10, wherein the midsole tapers in thickness along the arch cushion portion toward the forefoot outsole.

12. The footwear sole of claim 11, wherein the midsole has a first cushion thickness at the heel cushion portion and a second cushion thickness at the arch cushion portion that is less than the first cushion thickness, and wherein the midsole tapers in thickness along the arch cushion portion toward the forefoot outsole from the first cushion thickness to the second cushion thickness.

13. The footwear sole of claim 10, wherein the outsole sidewall has a sidewall heel segment extending upwardly from the heel outsole, and the outsole assembly has a heel cavity bounded from a heel end of the outsole assembly and the lateral and medial sides by the sidewall heel segment and from below by the heel outsole, the heel cavity open to the arch gap, and wherein the heel cushion portion is nested in the heel cavity.

14. The footwear sole of claim 13, wherein the outsole assembly has an aperture passing vertically therethrough over the arch gap laterally intermediate the bottom edges of the sidewall arch segment, the aperture extending axially along the arch gap from the heel cavity toward the forefoot outsole, and wherein the arch support surface extends axially along the arch gap from the heel cavity toward the forefoot outsole underneath the aperture.

15. The footwear sole of claim 13, wherein the sidewall heel segment has a heel segment lower portion extending upwardly from the heel outsole and a heel segment upper portion supported atop the heel segment lower portion, and wherein the sidewall arch segment is joined to the heel segment upper portion and spaced vertically apart from the heel outsole by the heel segment lower portion.

16. The footwear sole of claim 10, wherein the frame floor has a heel support surface extending over the heel outsole, the heel cushion portion supported atop the heel support surface and the arch support surface extending axially along the arch gap from the heel support surface.

17. The footwear sole of claim 10, wherein the arch support surface has a convex curvature along the arch gap.

18. The footwear sole of claim 10, wherein the frame floor extends over the heel outsole, the arch gap, and the forefoot outsole, and wherein the frame has a frame sidewall extending upwardly from a periphery of the frame floor and along the outsole sidewall, the midsole nested in the frame inboard of the frame sidewall.

19. The footwear sole of claim 10, wherein the outsole sidewall has a horizontally outer surface extending about the outer periphery of the outsole assembly, the horizontally outer surface formed of leather.

20. A footwear sole comprising:

a) an outsole assembly including a heel outsole, a forefoot outsole spaced axially apart from the heel outsole by an arch gap, and a sidewall extending between the heel outsole and the forefoot outsole, the sidewall having an elevated bottom edge extending axially along the arch gap on each of a medial and lateral side of the outsole assembly;

b) a support frame in the outsole assembly, the frame having an arch support surface extending axially along the arch gap at an elevation below at least a portion of each bottom edge; and c) a cushioning midsole in the outsole assembly and extending along the arch gap atop the arch support surface.

* * * * *